US005219305A

United States Patent [19]

Kawaguchi et al.

[11] Patent Number: 5,219,305

[45] Date of Patent: Jun. 15, 1993

[54] FILTER CONNECTOR AND METHOD OF MANUFACTURE

[75] Inventors: Yasuhito Kawaguchi, Hiratsuka; Hiroshi Kitamura, Kawasaki, both of Japan

[73] Assignee: The Whitaker Corporation, Wilmington, Del.

[21] Appl. No.: 878,574

[22] Filed: May 5, 1992

[30] Foreign Application Priority Data

May 31, 1991 [JP] Japan ..... 3-49199
Jul. 30, 1991 [JP] Japan ..... 3-73051

[51] Int. Cl.[5] ..... H01R 13/658

[52] U.S. Cl. ..... 439/620; 439/108; 29/832

[58] Field of Search ..... 439/108, 620; 333/182, 333/189; 29/832

[56] References Cited

U.S. PATENT DOCUMENTS 4,784,618 11/1988 Sakamoto et al. ..... 333/182 X
4,995,834 2/1992 Hasegawa ..... 439/620

*Primary Examiner*—Eugene F. Desmond
*Attorney, Agent, or Firm*—Adrian J. LaRue; Timothy J. Aberle

[57] ABSTRACT

A filter connector (40) for filtering unwanted signals from contacts (46) includes a housing (50) having therewith a subassembly (62) including an auxiliary plate (44) holding capacitors (43) in a spaced array, a grounding plate (42) having holes (41) on the spaced array to receive the capacitors inserted therewithin extending into recesses (49) of a ferrite plate (42) with the ferrite plate contiguous with the grounding plate. Contacts (46) are carried by the subassembly with contact ends (46*a*) projecting forwardly in the housing and post ends (46*b*) inserted into a PC board (60). The ground plate (42) includes terminals (54–56) projecting to connect the ground plate to ground circuits of the printed circuit board, suitably bent to provide support for the connector prior to soldering. Embodiments include a molded housing, in one form insert molded (50) around subassembly (62) or premolded (71) with the subassembly (62) secured therein.

18 Claims, 3 Drawing Sheets

FILTER CONNECTOR AND METHOD OF MANUFACTURE

This invention relates to a filter connector containing high frequency filters integrally assembled to contacts thereof.

The widespread use of electronics to transmit, manipulate, and employ high frequency signals, including digital pulses, in products ranging from computers to automobiles and appliances has developed an increasing need for filtering out unwanted components of signals. Such unwanted components termed noise, or electromagnetic interference, can not only cause errors in information but such errors can cause apparatus failure, sometimes serious to life and property. For this reason, filters of different designs to reduce unwanted signal components of different frequencies have been installed in electronic apparatus and particularly within connectors interconnecting the cables to such apparatus. U.S. Pat. No. 4,995,834 issued Feb. 26, 1991 is drawn to a noise filter connector wherein capacitors and a ferrite plate are employed to form an LC filter. There, the connector, including an outside metal shielding case, is made to include capacitors carrying the contacts of the connector with the capacitors mounted in the case to extend within the connector and further, a ferrite plate with post portions that pass through apertures in the plate to be inserted in a printed circuit board and soldered thereto. This example of the prior art places the ferrite plate outside of the connector shield and spaced from the feed through capacitors to expose the contacts to outside radiation and to cause a slight variation in the characteristics of the filter by virtue of different lengths of contact between different rows of contacts, the capacitors and the ferrite plate.

Accordingly, it is an object of the present invention to provide an improved filter connector wherein the filter elements are identically physically located with respect to each other and to a ground plane. It is a further object to provide a filter connector adapted for easy and consistent assembly of components forming the connector. It is still a further object to provide a method of manufacturing filter connectors that facilitates the provision of filter constructions in two embodiments.

A filter connector for filtering unwanted signals from contacts adapted to be mounted in a printed circuit board and to mate with a further connector plugged into such connector includes a plastic and insulating housing having a forward opening adapted to receive the further connector and a rearward opening adapted to receive a filter subassembly. The filter subassembly includes an auxiliary plate holding individual capacitors in a spaced array in conjunction with a grounding plate having holes therein adapted to receive the capacitors inserted en masse by use of the auxiliary plate. A ferrite plate having recesses in an inner surface thereof in an array matching the array of the holes in the auxiliary plate and the positioning of the capacitors is fitted against the grounding plate with the capacitors, as inserted in the grounding plate, fitting into the recesses of the ferrite plate. Thereafter, contacts are inserted through the capacitors and plate having an L-shape with forward ends adapted to mate with the contacts of the further connector and post portions adapted to be fitted into the holes of a printed circuit board. The grounding plate includes a plurality of legs extending from the bottom of the plate that have L-shaped portions including end posts of a configuration to allow at least one of the legs to be bent at right angles to the plane of the plate. This allows the plate to have a three-point leg projection with the legs fitted into holes in a printed circuit board to support the connector during assembly to a printed circuit board and prior to soldering. The subassembly formed by the auxiliary plate, the capacitors, the grounding plate, and the ferrite plate may be fabricated apart from the connector, inspected and tested, if necessary, and then assembled into the connector in one of two ways. In one application, the subassembly may be placed in a jig with the connector housing insert molded around the subassembly to provide a sealed version of the filter connector. In another embodiment, the subassembly may be fitted into a premolded housing and anchored thereto by the application of fasteners.

The invention will now be described by way of example with reference to the accompanying drawings in which.

Figure 6:
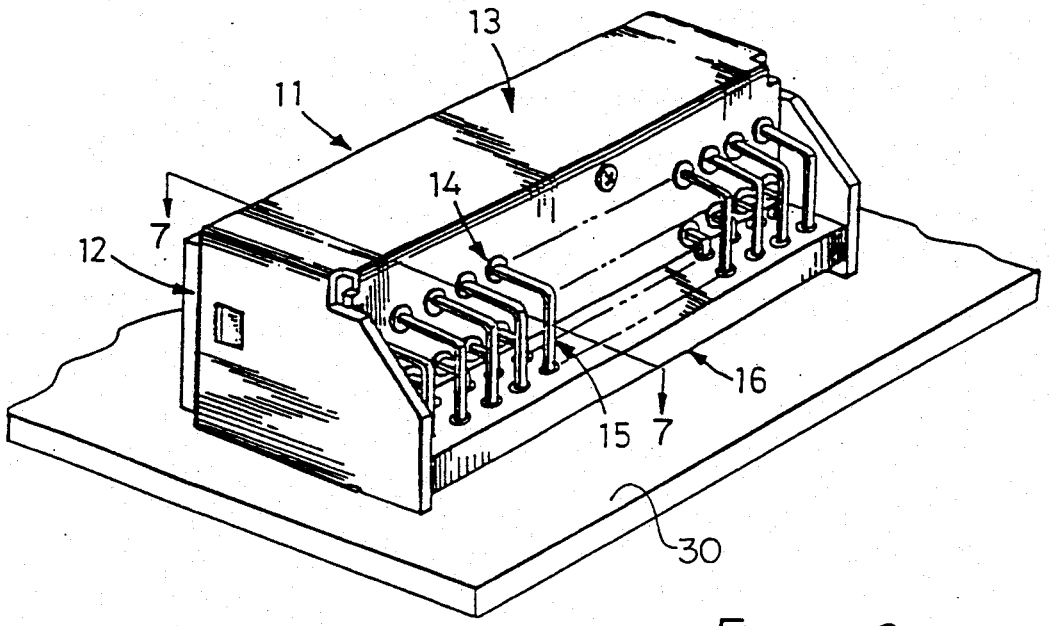
Figure 6 PRIOR ART
FIG. 6 is a perspective view of the connector in accordance with the prior art taken from the rear of the connector as mounted on the printed circuit board.
Figure 7:
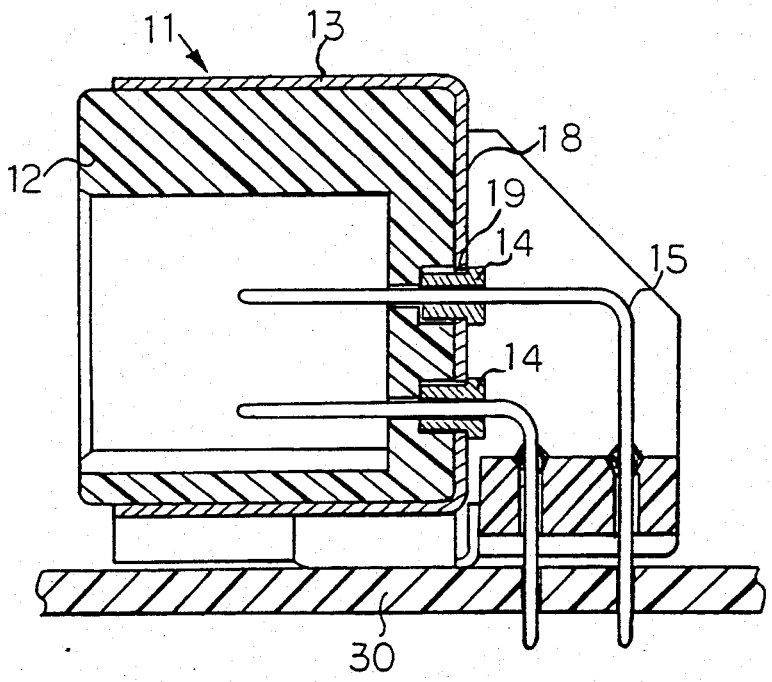
Figure 7 PRIOR ART
FIG. 7 is a sectional view of the connector of FIG. 6 taken through lines 7—7 of FIG. 6.

Referring first to FIGS. 6 and 7, a prior art representation of a filter connector 11 is shown to include a plastic housing 12 carried within an outer metallic shielding ground 13 mounted on the upper surface of a printed circuit board 30, the board having conductive traces (not shown) on such surface, within the board in laminations or on the underside surface of the board. Certain of these traces represent signal traces to carry signals to and from the board; other traces representing power traces to carry power to the board. Still other traces provide ground plane connections. Connector 11 is typical of an input/output or I/O connector widely used with respect to electronic circuits that require high frequency RF or digital signals, along with appropriate grounding and shielding circuits.

The connector 11 includes an LC network with respect to each of the contacts 15 shown extending through the connector and at right angles into the printed circuit board to be soldered to the traces thereon; including capacitor inserts 14 individual to the contacts and a common inductance provided by ferrite plate 16 through which the contacts pass. The capacitors 14 are fitted within the shell 13 through openings 19 in the rear wall of such shell. The contacts 15 extend forwardly within an opening in the housing 12 to mate with matching contacts of a mating connector plugged into connector 11. As can be seen from FIGS. 6 and 7, the capacitors 14 are separated from the ferrite plate 16 with the transmission path between capacitors and plate differing with respect to the upper row of contacts 15 and the lower row thereof to make an electrically different path link as well as having a substantial section of the contact exposed between capacitor and inductor formed by the plate.

Figure 1:
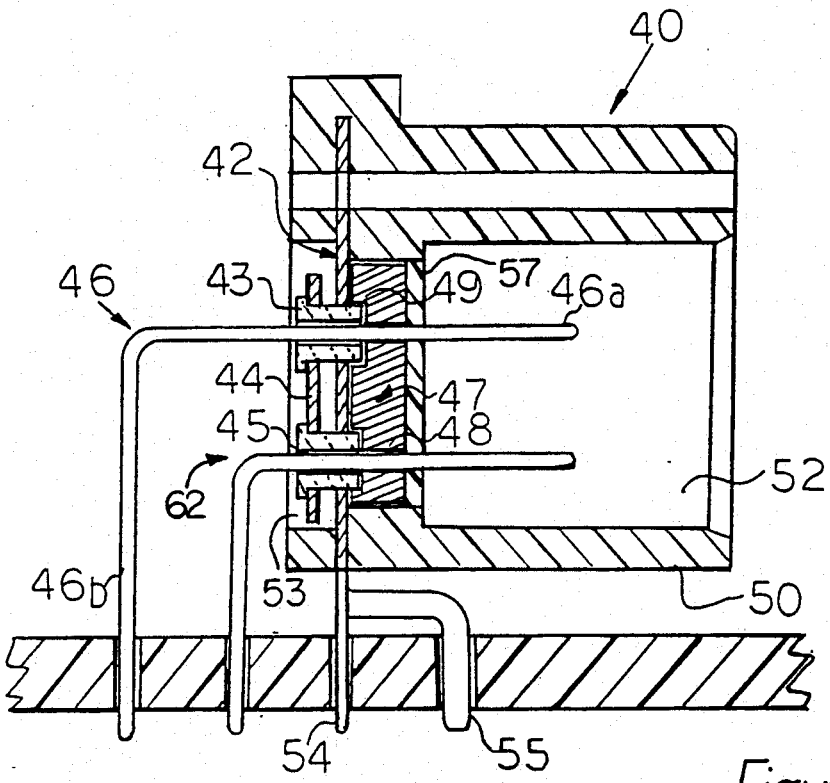
FIG. 1 is a side, elevational, and sectional view of the filter connector of the invention.
Figure 2:
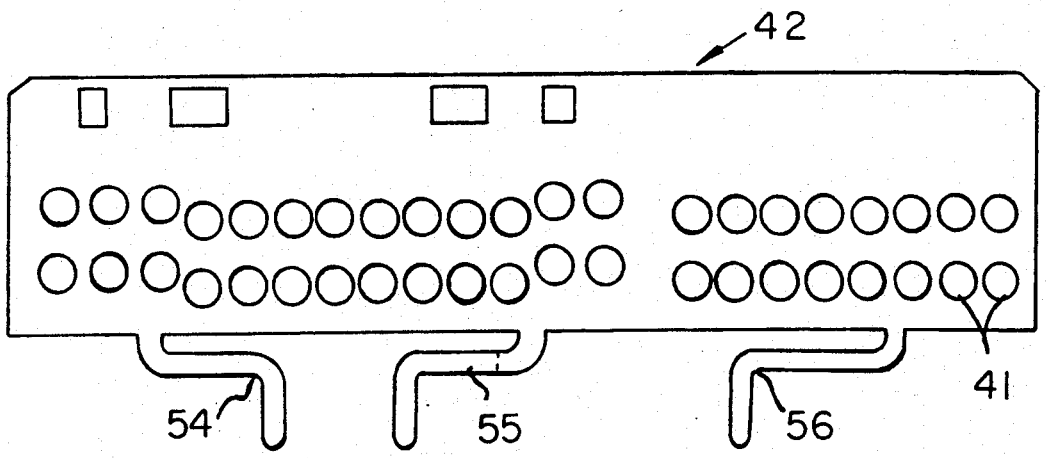
FIG. 2 is a front elevational view of the ground plate of the invention.

With this as background, reference is now made to FIGS. 1 and 2 where a similar connector 40 having a similar I/O function is shown mounted on a printed circuit board 60, with contacts 46 interconnected through post portions 46*b* to circuit traces (not shown) on or in board 60. The forward ends 46*a* of contacts 46 are positioned to be engaged by mating contacts of a mating connector that interconnects the I/O connector 40. Connector 40 has a plastic and insulating housing 50 with an interior forward facing opening 52 and rearward facing opening 53. A wall of insulating material 57 is shown in FIG. 1 to separate the opening 52 and opening 53. As can be discerned from FIG. 1, an LC network subassembly 62 is fitted within the housing 50. The subassembly 62 is comprised of a grounding plate 42 having a number of apertures 41 arrayed therein into rows with a plurality of posts 54, 55, and 56 each having a general L-shape extending from the bottom of the plate downwardly in a position to fit within holes in board 60 in the manner shown in FIG. 1. The subassembly 62 further includes an auxiliary plate 44 shown in FIG. 1. The plate 44 includes openings aligned with the openings 41 in plate 42 which are of a diameter to receive capacitors 43 that are round elements of a dimension to extend through ground plate 42 and they have holes 45 through which contacts 46 extend. The capacitors 43 reside in the rear opening 53 and disposed on the opposite side of plate 42 is a ferrite plate 47 that includes recesses 49 into which the ends of the capacitors are fitted and further including apertures 48 through which the contact 46 are inserted.

The invention contemplates that the capacitors 43 may be loaded into auxiliary plate 44 with the auxiliary plate carrying the capacitors then loaded into ground plate 42 en masse with the ferrite plate 47 then positioned against the ground plate with the ends of the capacitors fitted in the recesses 49. Thereafter, the contacts 46 may be added to the subassembly of capacitors plates and ferrite plate. The contacts, capacitors, plates and ferrite plate may be bonded together as by adhesive, tested, and thereafter incorporated into a connector in one of two fashions. The connector housing 50 of FIG. 1 is insert molded around the subassembly 62 with the wall 57 being flowed around contacts 46 and around the outer parts of the ground plane 42 to lock the housing material to the subassembly and effectively seal the interior opening 52 from the exterior through the engagement with contact pins and wall 57.

To be noted in FIG. 1, the post 55 of the ground plate is folded out away from the plane of the ground plate to provide, in conjunction with the posts 54 and 56, a three-point mounting of the connector, holding the connector in conjunction with the post portions 46*b* of contacts 46 prior to soldering of the posts to board 60. The posts 54, 55, and 56 would be soldered to the ground plane circuits of board 60, not shown, to effectively tie ground to the plate 42 and provide at least a rear shielding of the forward part of the leads. To be noted is the close proximity of capacitors, ground plate, and ferrite plate to present a lumped LC circuit operating with respect to each contact.

Figure 3:
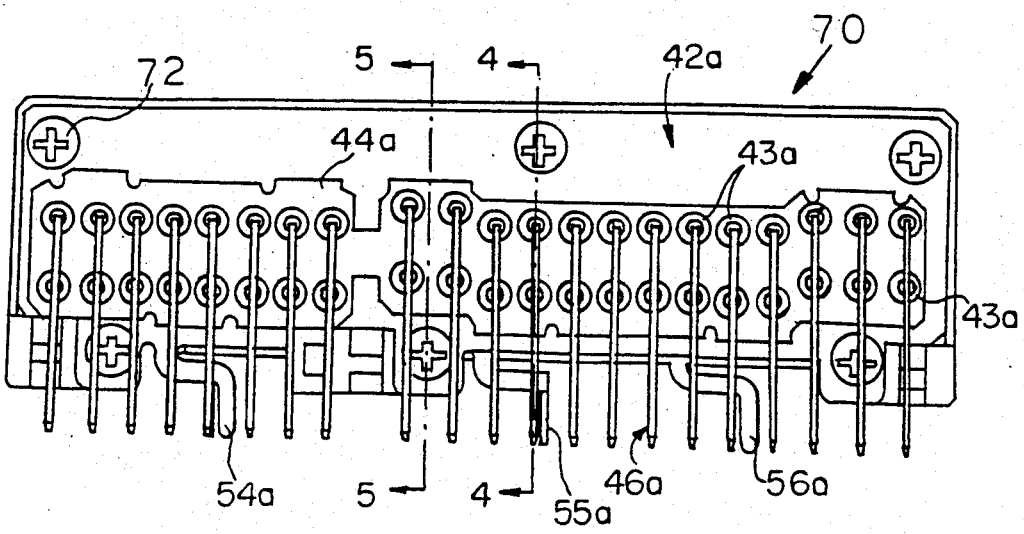
FIG. 3 is an elevational view of the rear of an alternative embodiment of the filter connector.
Figure 4:
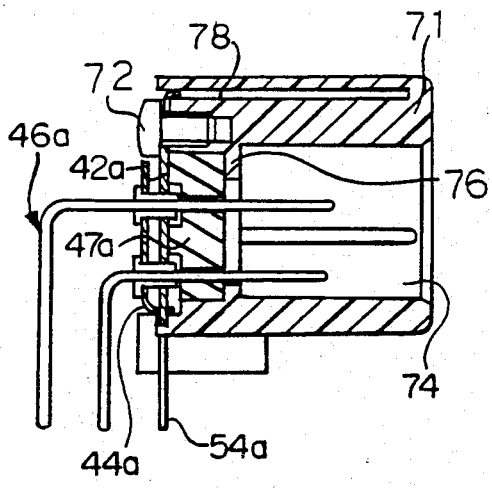
FIG. 4 is a section of the connector shown in FIG. 3 taken along lines 4—4.
Figure 5:
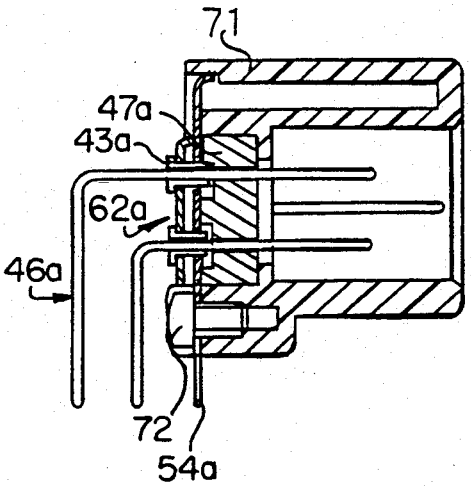
FIG. 5 is a section of the connector shown in FIG. 3 taken along lines 5—5.

An alternative construction is shown with respect to FIGS. 3, 4, and 5 wherein an I/O connector 70 includes a premolded housing 71 into which the L network forming the filter of the invention is later added and secured. This is shown in FIGS. 3, 4, and 5 to be accomplished by fasteners, such as screws 72, threaded into the material of housing 71 and through the ground plate 42*a*, apertures therein aligned with the fasteners. Housing 71 includes a forward facing opening 74 similar to opening 52 with respect to the embodiment of FIGS. 1 and 2, and a rearward facing opening filled with the subassembly 62*a*. As can be seen, the forward facing surface of ferrite plate 47*a* is fitted in against an interior wall 76 of housing 71 and the contacts 46*a* extend through such wall into the interior of opening 74. As can be seen in FIGS. 4 and 5, the top edge of plate 42*a* is bent to nest within a relief 78 of housing 71. Post 54*a* can be seen in FIGS. 4 and 5. As can be discerned, the subassembly 62*a* fits within the rear recess with the contacts 46*a* extending forwardly to engage a mating conductor and with the post portions thereof extending downwardly to fit within a printed circuit board, not shown, and be soldered thereto.

Thus, with respect to the embodiment of FIGS. 3–5, the invention contemplates a housing 71 first molded with the subassembly 62*a* fabricated and assembled into the housing using fasteners whereas in the earlier embodiment, insert molding of the housing around the subassembly 62 is contemplated.

Following the teaching of the present invention, a filter connector that is compact, rugged, and easy to handle and manufacture is taught with respect to an improved LC network comprised of individual capacitors and a common inductance in the form of a ferrite plate.

Having now described the invention in relation to drawings of preferred embodiments, claims are appended intended to define that which is inventive.

We claim:

1. A filter connector comprising an insulating housing having an interior opening forwardly oriented to receive a mating connector and be interconnected thereto along a given axis, said housing including a rearwardly directed opening having a filter subassembly fitted therein, the filter subassembly including a grounding plate covering over said rearwardly directed opening and disposed transversely to the given axis, said plate including fingers projecting downwardly from the housing to engage a printed circuit board and support the connector thereon prior to soldering of the fingers to such board, said plate including a plurality of holes each carrying a capacitor extending through the plate, a ferrite plate mounted contiguous to the grounding plate on the forwardly oriented side of said connector, an array of contacts extending through the capacitors, and ferrite plate to form contact sections extending in the forwardly oriented opening with post portions extending from the rearwardly faced opening to be inserted in the printed circuit board.

2. The connector of claim 1 wherein the said housing is insert molded around the subassembly to mount and retain said subassembly relative to said housing.

3. The connector of claim 1 wherein the said housing is premolded with the subassembly fitted therein and including fasteners fastening the subassembly to the housing.

4. The connector of claim 1 wherein said grounding plate includes at least one post bent transversely to the plane of the grounding plate to provide support for the said housing and connector when mounting into a printed circuit board in conjunction with the posts.

5. The connector of claim 1 wherein said posts are L-shaped with a downward projecting portion connected by a segment parallel to the plane of said plate through a leg spaced from an edge of said ground plate.

6. A filter connector, comprising:

a dielectric housing having a rearwardly-directed opening in which a filter subassembly is secured;

said filter subassembly including a ferrite plate, and a ground plate having holes in which capacitors are disposed;

said ferrite plate positioned adjacent said ground plate and having apertures aligned with the ground plate holes;

electrical contacts having sections extending through the capacitors and through the ferrite plate apertures; and securing means provided by the subassembly and the housing securing the subassembly in the rearwardly-directed opening of the housing.

7. A filter connector as claimed in claim 6, wherein said housing is insert molded onto the subassembly thereby forming the rearwardly-directed opening on which the subassembly is disposed.

8. A filter connector as claimed in claim 6, wherein said housing is premolded with said rearwardly-directed opening in which the subassembly is disposed with said securing means including fasteners fastening the subassembly to the housing.

9. A filter connector as claimed in claim 6, wherein an auxiliary plate having other holes therein in which said capacitors are disposed is positioned adjacent said ground plate.

10. A filter connector as claimed in claim 6, wherein ground posts extend outwardly from said ground plate and said housing.

11. A filter connector as claimed in claim 6, wherein recesses are disposed in said ferrite plate surrounding said apertures so that ends of the capacitors are disposed therein.

12. A method for manufacturing filter connectors including the steps of:

a. providing a first plate having holes therein in a given array, b. loading said holes with capacitors made to extend through such first plate, c. providing a second plate having holes in said given array, d. assembling the plate with capacitors extending through the holes of the second plate, e. providing a ferrite plate with recesses aligned in said given array, assembling the said ferrite plate to the said second plate with the recesses receiving the ends of the capacitors in an interesting relationship, f. assembling contacts by inserting such contacts through the said capacitors and ferrite plate thereby forming a subassembly, and g. providing a dielectric connector housing with said subassembly affixed thereto.

13. The method of claim 12 wherein said step of providing the dielectric connector housing includes molding the plastic housing around said subassembly.

14. The method of claim 12 wherein the step of providing the dielectric connector housing includes premolding the housing with said subassembly molded therein and affixed thereto.

15. A method of making a filter connector, comprising the steps of:

positioning capacitors in holes in a ground plate;

placing a ferrite plate adjacent said ground plate so that apertures of the ferrite plate are aligned with the ground plate holes;

inserting electrical contacts into the capacitors with sections thereof extending through the ferrite plate apertures thereby forming a subassembly;

providing a dielectric housing with a cavity; and affixing the subassembly to the housing within the cavity of the housing.

16. A method as claimed in claim 15, wherein the step of affixing the housing to the subassembly comprises insert molding the housing onto the ground plate and forming an interior wall of the housing against which the ferrite plate engages.

17. A method as claimed in claim 15, wherein the step of affixing the housing to the subassembly comprises placing the subassembly within a cavity of the housing and securing the ground plate to the housing.

18. A method as claimed in claim 15, comprising the additional step of positioning an auxiliary plate having other holes adjacent said ground plate with the capacitors being disposed in aligned holes of the plates.

* * * * *